US008058325B2

(12) United States Patent
Seiterle et al.

(10) Patent No.: US 8,058,325 B2
(45) Date of Patent: Nov. 15, 2011

(54) PROCESS FOR PRODUCING A CASTING MOLD

(75) Inventors: Wolfram Seiterle, Hilzingen (DE); Artur Bissert, Stockach (DE)

(73) Assignee: Georg Fischer Automobilguss GmbH, Singen (DE)

( * ) Notice: Subject to any disclaimer, the term of this patent is extended or adjusted under 35 U.S.C. 154(b) by 30 days.

(21) Appl. No.: 12/029,487

(22) Filed: Feb. 12, 2008

(65) Prior Publication Data

US 2008/0190320 A1 Aug. 14, 2008

Related U.S. Application Data

(63) Continuation-in-part of application No. PCT/EP2006/004821, filed on May 22, 2006.

(30) Foreign Application Priority Data

Aug. 13, 2005 (EP) ..... 05017698

(51) Int. Cl.
*B22C 1/00* (2006.01)
*B22C 1/22* (2006.01)

(52) U.S. Cl. ..... 523/139; 523/142; 523/143

(58) Field of Classification Search ..... 523/139, 523/142–143; 260/2.1, 2.5; 521/116, 121; 426/103

See application file for complete search history.

(56) References Cited

U.S. PATENT DOCUMENTS

| | | | | |
|---|---|---|---|---|
| 2,145,317 | A | 1/1939 | Salzberg | |
| 3,062,760 | A * | 11/1962 | Dermody et. al. | 264/49 |
| 3,124,547 | A * | 3/1964 | Meltzer et al. | 521/64 |
| 3,375,208 | A * | 3/1968 | Duddy | 521/28 |
| 3,376,238 | A * | 4/1968 | Gregorian et al. | 264/49 |
| 4,396,430 | A | 8/1983 | Matalon | |
| 4,426,462 | A * | 1/1984 | Weissenfels et al. | 521/116 |
| 6,013,125 | A | 1/2000 | Quraishi et al. | |
| 6,703,057 | B2 * | 3/2004 | Duffett | 426/103 |
| 7,645,814 | B2 * | 1/2010 | Schrey et al. | 523/139 |
| 2005/0176845 | A1 | 8/2005 | Schrey et al. | |

FOREIGN PATENT DOCUMENTS

| | | |
|---|---|---|
| DE | 1255239 | 11/1967 |
| WO | WO 2004000484 A1 * | 12/2003 |

OTHER PUBLICATIONS

"Castor Sugar." SugarIndia. http://www.sugarindia.com/cast.htm, Available on Web Apr. 15, 2010, pp. 1-2.*

"Powdered sugar." [online]. Wikipedia, the Free Encylopedia [retrieved on Mar. 16, 2011] Retrieved on the Internet <URL:http://en.wikipedia.org/wiki/Powdered_sugar>.*

"Sugars." [online]. The Cook's Theasurus, 1996-2005 [Retrieved on Mar. 16, 2011] Retrieved From the Internet <URL:http://www.foodsubs.com/Sweeten.html>.*

* cited by examiner

*Primary Examiner* — Vasu Jagannathan
*Assistant Examiner* — Hannah Pak
(74) *Attorney, Agent, or Firm* — Bachman & LaPointe, P.C.

(57) ABSTRACT

A process for producing casting cores or molds from a mold material, based on mold base material and organic or inorganic binder, an additive composed of pore former, icing sugar and/or a similar carbon compound, and dye being admixed to the mold material and/or the binder.

6 Claims, No Drawings

PROCESS FOR PRODUCING A CASTING MOLD

CROSS REFERENCE TO RELATED APPLICATIONS

This application is a Continuation-in-Part of International Application No. PCT/EP2006/004281 filed May 22, 2006.

BACKGROUND OF THE INVENTION

The invention relates to a process for producing casting cores or molds for casting molds comprising a mold base material and a binder and to casting cores or molds after production of the process.

The function of casting cores is to form cavities in the casting or to form undercut outer contours. This kind of casting cores are produced conventionally in core boxes by means of core shooting units, where the molding sand, provided with binder and, where appropriate, with additives, is introduced using compressed air into the cavities of the core mold boxes. The binders used are generally liquid synthetic resins or inorganic binders.

The invention relates to all organic and inorganic mold and core production processes, preferably to the urethane cold box process and/or the resole-$CO_2$ process. Likewise possible are physical processes, examples being ultrasound processes.

Urethane cold box coremaking takes place in cold core boxes using organic binder systems, which are gas-cured directly in the core box by means for example of tertiary amines. Solidification of the molding material mixture (e.g., quartz sand, organic binding system, curing agent) takes place after the mold material has been introduced into the cold core box, by means of a gaseous catalyst or of a gaseous tertiary amine. The individual components are mixed beforehand in specialty apparatus. One advantage of this urethane cold box process, among others, lies in the achievement of high strengths in the cores or molds.

Other processes, e.g., what are called resole-$CO_2$ processes, are coremaking processes with alkali-condensed phenolic resin binder, which for curing is gassed with carbon dioxide. As with the urethane cold box process, the mold material is based generally on quartz sand mold base material.

This process is distinguished by the prevention of "veins" in the casting operation. Disadvantages of this gassing process are lower strengths, the reasons for which are increased erosion and inadequate thermal stability.

The finished molded cores can be used without a washcoat, or coated with a wash. Washes are refractory materials in powder, liquid or paste form for producing a thin coating on the casting cores. The core wash has a number of functions. They include heat insulation, smoothing, the prevention of sticking of metal to the mold wall, the prevention of veining, and hence the assurance of reliable separation of the casting from the mold wall when the mold is discharged.

After the casting operation of the finished casting the casting cores are removed from the casting. The casting cores are removed for example by blasting, vibration, blowing out, knocking or washing out.

DE 102 27 512 A1 discloses such a process, based on a mold base material comprising phenolic resin and isocyanate, a pore former being added to the mold base material.

DE 195 25 307 A1 disclosed a casting core for casting molds. The proposal is for a casting core for casting molds comprising a dry substance which is solidified by means of a binder and which loses its shape as a result of exposure to water.

DE 195 49 469 A1 describes a casting core for casting molds, comprising molding sand solidified by means of a water-soluble binder based on polyphosphates, the binder being instantized sodium polyphosphate and a mixing ratio of 3 to 7 parts by weight of binder and 0.5 to 2 parts by weight of water per 100 parts by weight of molding sand being provided.

DE 199 14 586 A1 discloses a resin-based binder for producing foundry sands for use in foundry practice. The binder mixture for core sand production is composed of a single component (single resin) or of a mixture of one or more single components (resin mixture) with additives.

The invention is based on the object of producing non-washcoated cores/molds having a suitable casting surface in the core region, and of prolonging the life of the sand during core production. A further aim is to prevent the clogging of the sand mixers and sand hoppers above the core shooting machines.

SUMMARY OF THE INVENTION

In accordance with the invention this object is achieved by admixing commercial powdered sugar to the pore former.

DETAILED DESCRIPTION

The addition of commercial powdered sugar prolongs the life of the sand, i.e., the sand can be processed for longer without any adverse course in the mechanical values of the cores manufactured.

Furthermore, the clogging of the sand mixers and sand hoppers above the core shooting machines is prevented. The addition of icing sugar improves the flow behavior during core shooting.

Furthermore, an improved edge definition and core contour reproduction is obtained.

As a result of the addition of addition of powdered sugar, glossy carbon is formed on casting, and hence a smooth surface is formed in the core region.

A further preferred measure is the addition of dye. The machinist can see from this dye whether additive is present in the core sand mixture. The addition also makes it possible to monitor the metering unit of the sand mixer.

In accordance with one particularly preferred embodiment of the process the binder is composed in a 1:1 ratio of a phenolic resin component and an isocyanate component, the two binder components being introduced into the mold material simultaneously or in succession and subsequently mixed.

Preferably the powdered sugar and the dye are mixed into the sand in such a way that a homogeneous mixture is produced.

Specified below is one particularly advantageous working example of the composition of the mixture of quartz sand and binder for the production process of the invention.

| | |
|---|---|
| 100 | parts quartz sand |
| 0.5-0.8 | parts resin (phenolic resin, for example) |
| 0.5-0.8% | parts activator (isocyanate, for example) |
| 1.0-2.0 | parts additive of the invention (comprising powdered sugar and dye) |

The weight fractions of resin and isocyanate can be between 0.5 and 0.8, depending on the desired strength of the casting cores. In general, resin and isocyanate are added in equal amounts, i.e., in a 1:1 ratio.

An example of a composition of the additive of the invention:

| | |
|---|---|
| 100 | parts pore former |
| 1.0-10 | parts commercially powdered sugar with a particle size <1 mm |
| 1.0-5.0 | parts dye (for example, Hostaperm B4G-KR or E131 Patent Blue) |

The additive of the invention is generally added in an amount of 1 to 2 parts per 100 part quartz sand.

In the following a typical exemplary course of a casting core production process is described.

Weighing-out of the quartz sand or volumetric metering running of the quartz sand into a batch mixer metering of the resin component and isocyanate component via metering pumps. Metering may take place in parallel or sequentially the additive of the invention is added sequentially, in parallel with the metering of sand into the sand mixer the mixing time is up to 200 seconds, depending on the desired requirements and type of mixer processing of the wet mixture on the core shooting machine removal of the cores placing of the finished cores into the sand mold for the actual casting operation

The invention claimed is:

1. A process for producing a casting mold comprising admixing a base mold material, a binder and a pore former wherein the pore former comprises icing sugar having a grain size of less than 1 mm.

2. The process of claim 1, wherein a dye is added to the pore former.

3. The process of claim 1, wherein the binder comprises a phenolic resin component and an isocyanate component, and the base mold material comprises quartz sand.

4. A process for producing a casting mold comprising admixing a base mold material, a binder and a pore former wherein the pore former comprises icing sugar grains wherein all of the grains have a grain size of less than 1 mm.

5. The process of claim 4, wherein a dye is added to the pore former.

6. The process of claim 4, wherein the binder comprises a phenolic resin component and an isocyanate component, and the base mold material comprises quartz sand.

* * * * *